US011002235B2

(12) United States Patent
Inoue et al.

(10) Patent No.: US 11,002,235 B2
(45) Date of Patent: May 11, 2021

(54) FUEL INJECTION DEVICE

(71) Applicant: DENSO CORPORATION, Aichi-pref. (JP)

(72) Inventors: Kojiro Inoue, Kariya (JP); Jun Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 22 days.

(21) Appl. No.: 16/021,121

(22) Filed: Jun. 28, 2018

(65) Prior Publication Data

US 2019/0017478 A1 Jan. 17, 2019

(30) Foreign Application Priority Data

Jul. 12, 2017 (JP) ..... JP2017-136432

(51) Int. Cl.
*F02M 51/06* (2006.01)
*F02M 47/02* (2006.01)
*F02M 63/00* (2006.01)

(52) U.S. Cl.
CPC ..... *F02M 51/0607* (2013.01); *F02M 47/027* (2013.01); *F02M 51/0657* (2013.01); *F02M 63/0026* (2013.01); *F02M 2200/21* (2013.01); *F02M 2200/28* (2013.01); *F02M 2200/46* (2013.01); *F02M 2547/001* (2013.01)

(58) Field of Classification Search
CPC ..... F02M 51/0607; F02M 47/027; F02M 51/0657; F02M 63/0026; F02M 2200/21; F02M 2200/46; F02M 51/061
USPC ..... 239/96, 533.2–533.12
See application file for complete search history.

(56) References Cited

U.S. PATENT DOCUMENTS 7,703,708 B2 * 4/2010 Matsumoto ..... F02M 47/027 239/102.2
2003/0006296 A1 * 1/2003 Rodriguez-Amaya ..... F02M 47/027 239/88
2011/0240768 A1 10/2011 Fujikake et al.
2012/0175435 A1 7/2012 Yamashita et al.

FOREIGN PATENT DOCUMENTS

JP 2002-364483 12/2002
JP 5531713 6/2014
JP 2015-090088 5/2015

* cited by examiner

*Primary Examiner* — Christopher S Kim
(74) *Attorney, Agent, or Firm* — Nixon & Vanderhye P.C.

(57) ABSTRACT

A fuel injection device is provided with a valve body, a nozzle needle, a movable plate, and a support spring. The valve body has a control chamber therein. The control chamber is defined by a defining wall which has a dividing wall portion. The dividing wall portion divides the control chamber into an accommodation chamber and a backpressure chamber. The accommodation chamber accommodates a movable plate and a support spring. A fuel pressure in the backpressure chamber is applied to the nozzle needle. The dividing wall portion has a restriction hole fluidly connecting the accommodation chamber and the backpressure chamber with each other, and a support surface supporting the support spring.

12 Claims, 5 Drawing Sheets

FUEL INJECTION DEVICE

CROSS-REFERENCE TO RELATED APPLICATION

This application is based on Japanese Patent Application No. 2017-136432 filed on Jul. 12, 2017, the disclosure of which is incorporated herein by reference.

TECHNICAL FIELD

The present disclosure relates to a fuel injection device which injects fuel into an internal combustion engine through an injection port.

BACKGROUND ART

JP 2012-154314 A (US 2012/0175435 A1) shows a fuel injection device which has a body defining a pressure chamber and an injection port therein, a nozzle needle opening/closing the injection port according to a fuel pressure in the pressure chamber, and a floating plate accommodated in the pressure chamber. A plate spring is disposed between the floating plate and the nozzle needle. The plate spring biases the float plate toward an inlet port.

In these years, it is required for the fuel injection device to increase a fuel injection quantity which is injected during a specified time period. In order to increase the fuel injection quantity, it is necessary that a needle lift amount is kept large. However, when the needle lift amount is enlarged in the fuel injection device shown in JP 2012-154314 A, it is likely that an accuracy of fuel injection quantity may be deteriorated due to following two points.

First, a pressure pulsation is generated in the pressure chamber due to its volume enlargement. Specifically, the volume of the pressure chamber is needed to be enlarged in order to increase the needle lift amount. However, when the volume of the pressure chamber is enlarged, a pulsation period of the fuel pressure will become longer along with a fuel outflow from the pressure chamber. Consequently, it takes long time period to converge the pressure pulsation, so that a displacement of the nozzle needle becomes unstable in a valve opening direction.

Secondarily, a float spring is excessively compressed. Specifically, when a needle lift amount is enlarged, a floating spring is compressed largely between a nozzle needle and a floating plate. A biasing force of the floating spring applied to the floating plate becomes uneven, so that the floating plate will be tilted. Consequently, a behavior of the floating plate opening/closing an inlet port varies, so that a displacement of the nozzle needle becomes unstable in a valve closing direction.

SUMMARY

It is an object of the present disclosure to provide a fuel injection device which can keep a high accuracy in fuel injection quantity even when a displacement of a nozzle needle is enlarged in a valve opening direction.

According to the present disclosure, a fuel injection device has a valve body which defines an injection port, a control chamber filled with a fuel, an inlet passage for introducing the fuel into the control chamber, and an inlet passage for discharging the fuel from the control chamber; a needle which will be displaced by a variation in fuel pressure in the control chamber so as to open/close the injection port; and a closing member which is accommodated in the control chamber in a displaceable manner so as to close an inlet opening of the inlet passage. The inlet opening opens on an opening wall confronting the control chamber. The fuel injection device further has a biasing member which is accommodated in the control chamber in such a manner as to bias the closing member toward the opening wall.

The control chamber is defined by a defining wall which has a dividing wall portion. The dividing wall portion divides the control chamber into a backpressure chamber for applying a fuel pressure to the needle and an accommodation chamber accommodating the closing member and the biasing member. The dividing wall portion has a restriction hole fluidly connecting the accommodation chamber and the backpressure chamber with each other. The dividing wall portion has a support surface supporting the biasing member.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
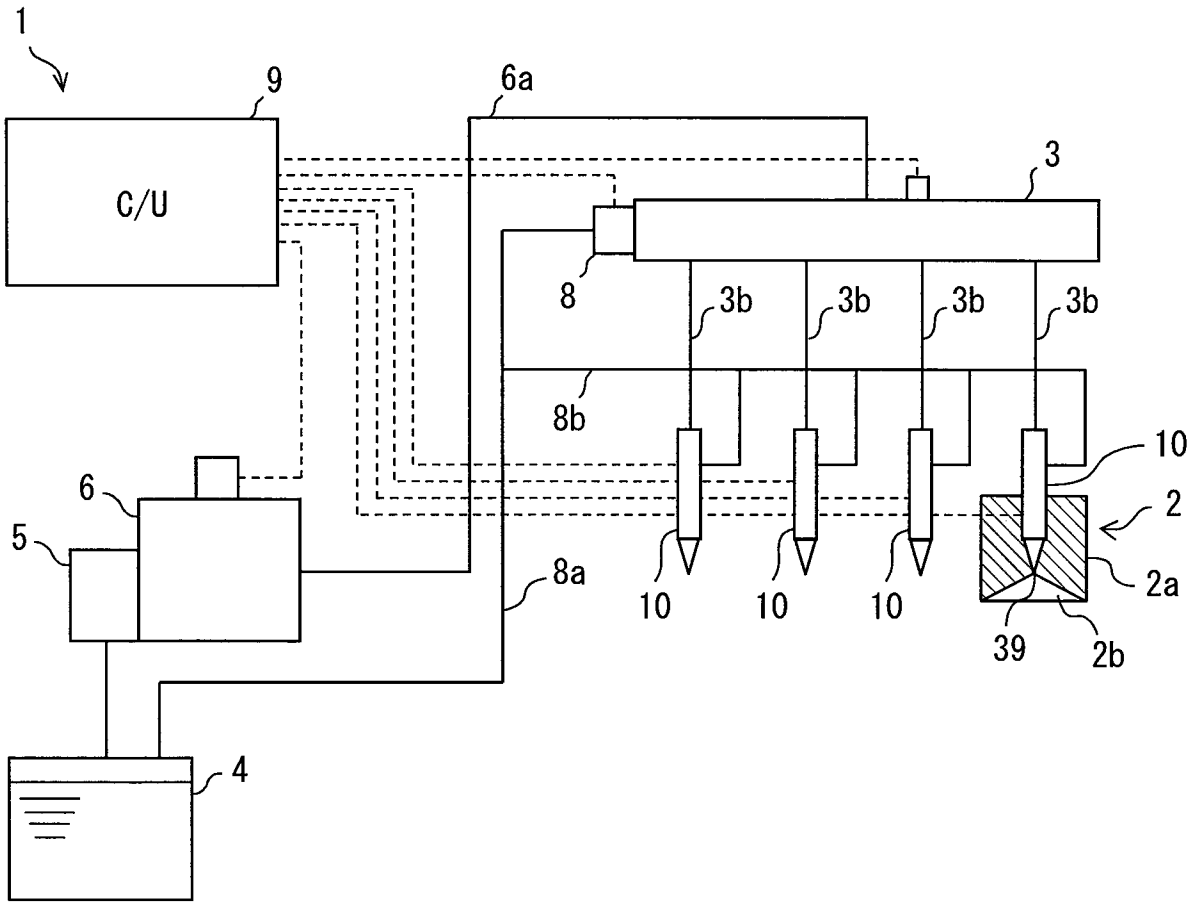
FIG. 1 is a schematic chart showing an entire configuration of a fuel supply system including a fuel injection device according to a first embodiment.

Referring to drawings, a plurality of embodiments of the present disclosure will be described, hereinafter. In each embodiment, the same parts and the components are indicated with the same reference numeral and the same description will not be reiterated. In a case where only a part of configuration is explained in each embodiment, a configuration of preceding embodiment can be applied as the other configuration. Moreover, the configuration of each embodiment can be combined with each other even if it is not explicitly described.

First Embodiment

A fuel injection device 10 is applied to a fuel supply system 1 shown in FIG. 1. The fuel injection device 10 supplies fuel stored in a fuel tank 4 to each combustion chamber 2*b* of a diesel engine 2. The fuel supply system 1 is provided with a feed pump 5, a high-pressure fuel pump 6, a common-rail 3, a control unit 9 etc. along with the fuel injection device 10.

The feed pump 5 is an electric pump such as a trochoid-type pump. The high-pressure fuel pump 6 includes the feed pump 5 therein. The feed pump 5 feeds light oil stored in the fuel tank 4 to the high-pressure fuel pump 6. The feed pump 5 may be provided in the fuel tank 4 independently.

The high-pressure fuel pump 6 is a plunger pump. The high-pressure fuel pump 6 is driven by an output shaft of the engine 2. The high-pressure fuel pump 6 is fluidly connected to the common-rail 3 through a fuel pipe 6*a*. The high-pressure fuel pump 6 increases the pressure of the fuel supplied from the feed pump 5, and supplied the high-pressure fuel to the common-rail 3.

The common-rail 130 is fluidly connected to multiple fuel injection devices 10 through a high-pressure fuel pipe 3*b*. The common-rail 130 is fluidly connected to the fuel tank 4 through a surplus-fuel pipe 8*a*. The common-rail 3 stores the high-pressure fuel supplied from the high-pressure fuel pump 6, and distributes the high-pressure fuel to each fuel injection device 10. The common-rail 3 is provided with a pressure-reducing valve 8. The pressure-reducing valve 8 discharges surplus fuel from the common-rail 3 to the surplus-fuel pipe 8*a* when a fuel pressure in the common-rail 3 exceeds a target fuel pressure.

The control unit 9 is an electronic control unit electrically connected to each fuel injection device 10. The control unit 9 controls fuel injection of each fuel injection device 10 according to a driving condition of the engine 2. The control unit 9 includes a microcomputer, a drive circuit for applying a drive current to an electromagnetic control valve 40 (refer to FIG. 2) of each fuel injection device 10, etc.

The fuel injection device 10 is provided to a cylinder head 2*a* which defines a combustion chamber 2*b* therein. The fuel injection device 10 injects the high-pressure fuel supplied from the high-pressure fuel pipe 3*b* into the combustion chamber 2*b* through an injection port 39. The fuel injection device 10 has a valve structure which controls a fuel injection through the injection port 39. The fuel injection device 10 utilizes fuel pressure of the high-pressure fuel in order to open/close the injection port 39. A part of the fuel supplied to the fuel injection device 10 is returned to the fuel tank 4 through a return pipe 8*b* and a surplus-fuel pipe 8*a*.

Figure 2:
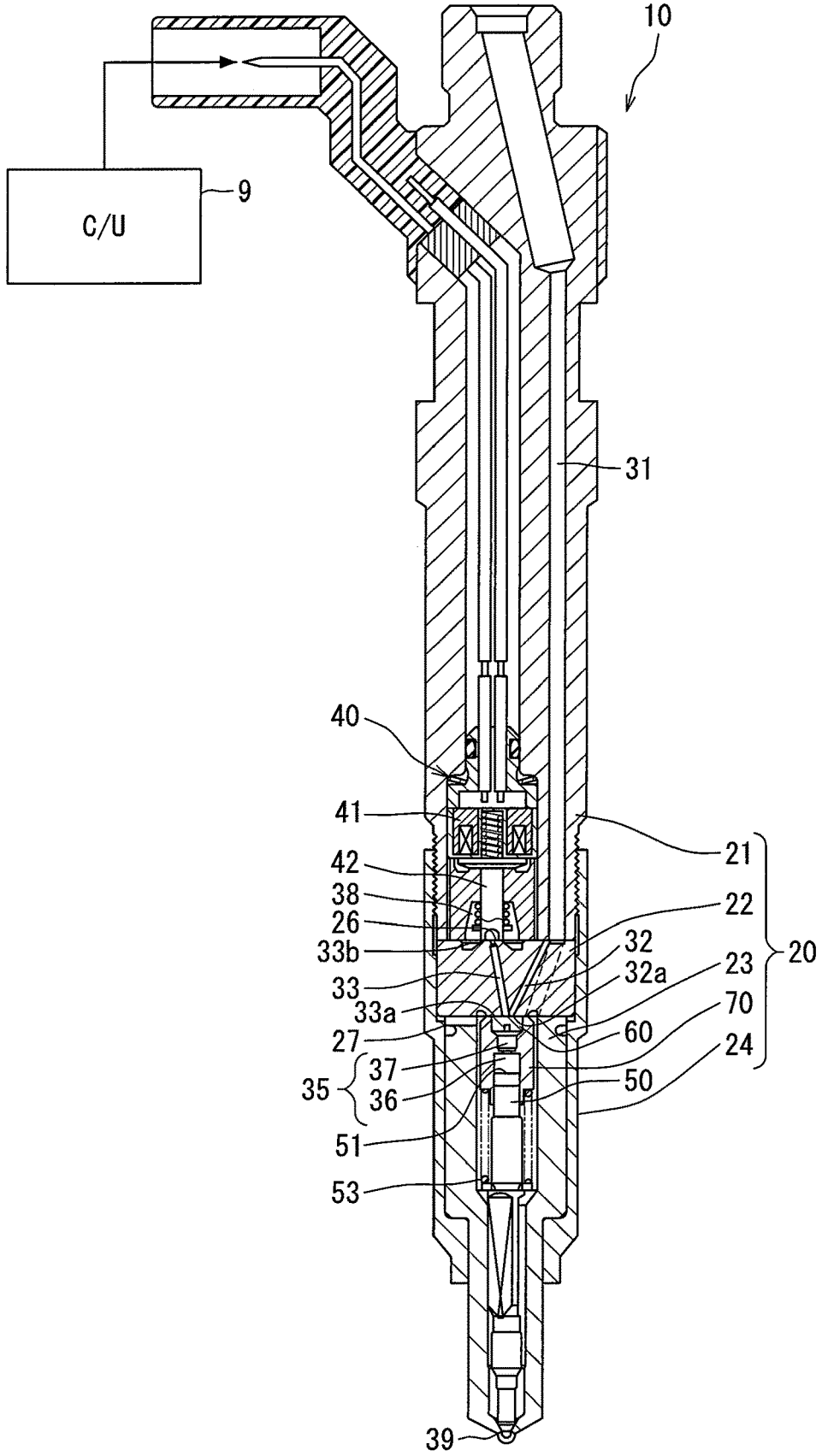
FIG. 2 is a longitudinal sectional view illustrating the fuel injection device according to the first embodiment.
Figure 3:
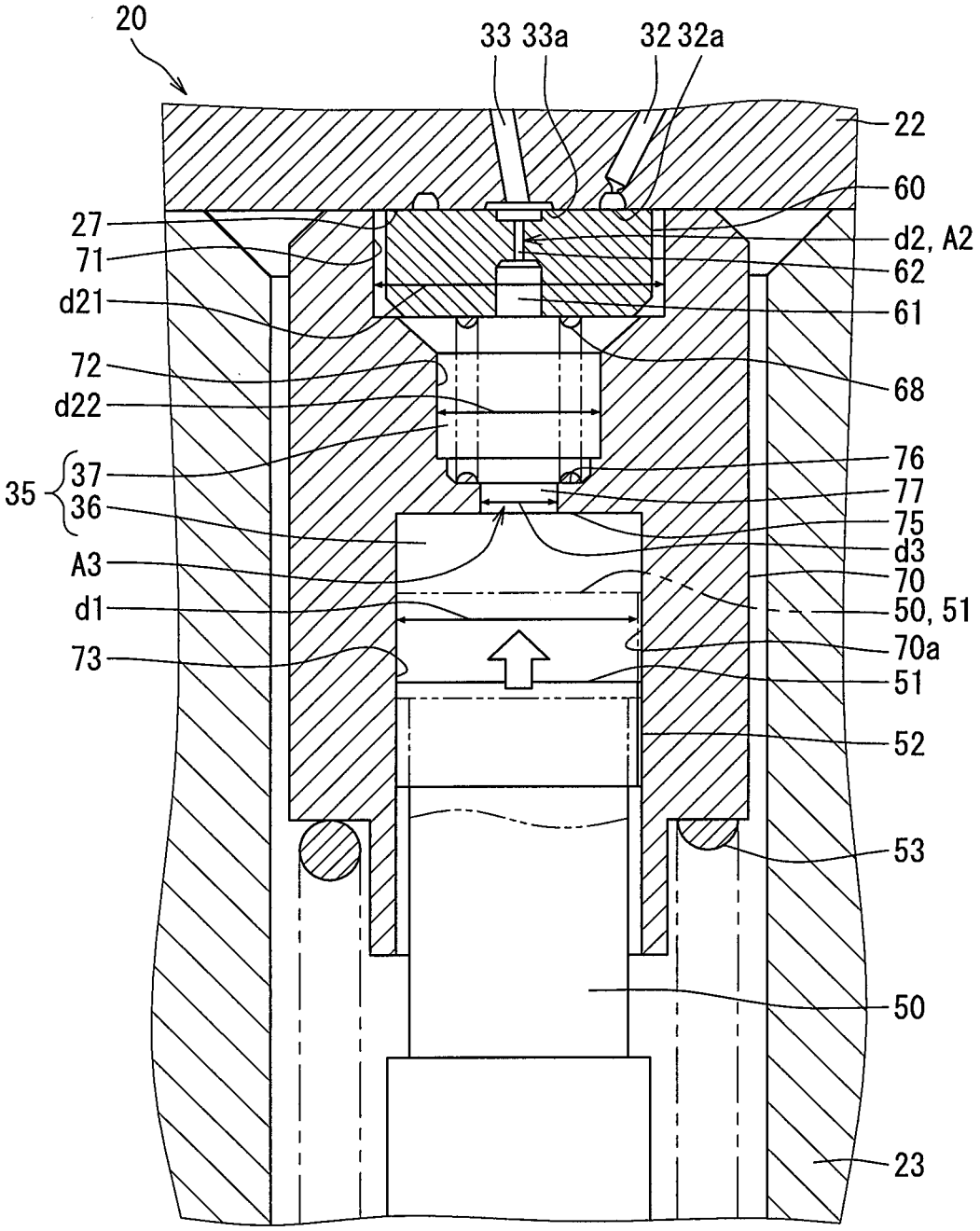
FIG. 3 is a longitudinal sectional view illustrating a vicinity of a control chamber in the fuel injection device according to the first embodiment.

As shown in FIGS. 2 and 3, the fuel injection device 10 is provided with a valve body 20, a nozzle needle 50, the electromagnetic control valve 40, a movable plate 60, and a support spring 68.

The valve body 20 includes an injector body member 21, a passage-forming member 22, a nozzle body member 23, a retaining nut 24, a cylinder 70, etc. The valve body 20 defines a high-pressure passage fuel 31, an inlet passage 32, an outlet passage 33, a control chamber 35 and a low-pressure chamber 38 therein. Further, the valve body 20 defines a control seat surface 26, an opening wall 27 and the injection port 39.

The high-pressure fuel passage 31 extends in the injector body member 21, the passage-forming member 22, and the nozzle body member 23. The high-pressure fuel passage 31 is fluidly connected to the high-pressure pipe fuel 3*b* (refer to FIG. 1). The high-pressure fuel supplied from the common-rail 3 through the high-pressure fuel pipe 3*b* flows to the injection port 39 through the high-pressure fuel passage 31.

The inlet passage 32 is branched from the high-pressure fuel passage 31 in the passage-forming member 22 so as to fluidly connect the high-pressure fuel passage 31 and the control chamber 35. The inlet passage 32 introduces a part of the high-pressure fuel flowing through the high-pressure fuel passage 31 into the control chamber 35. One end of the inlet passage 32 confronting the control chamber 35 is opened on an opening wall 27 as an inlet opening 32*a*. The inlet opening 32*a* can be a circular opening or an annular opening.

The outlet passage 33 is a fuel passage which is defined adjacently to the inlet passage 32 in the passage-forming member 22. The outlet passage 33 fluidly connects the control chamber 35 and the low-pressure chamber 38. The fuel in the control chamber 35 flows out to the low-pressure chamber 38 through the outlet passage 33. One end of the outlet passage 33 confronting the control chamber 35 is opened on the opening wall 27 as an outlet opening 33*a*. The other end of the outlet passage 33 confronting the low-pressure chamber 38 is opened on the control seat surface 26 as a discharge opening 33*b*. The outlet opening 33*a* and the discharge opening 33*b* are circular openings.

The control chamber 35 is defined by the passage-forming member 22, the cylinder 70, the nozzle needle 50, etc. The control chamber 35 is positioned at opposite side of the injection port 39 with respect to the nozzle needle 50. The control chamber 35 is filled with the fuel supplied through the inlet passage 32. The fuel pressure in the control chamber 35 depends on the fuel quantity which flows in/out through the inlet passage 32/the outlet passage 33.

The low-pressure chamber 38 is a space defined in the injector body member 21. The low-pressure chamber 38 accommodates the electromagnetic control valve 40 therein. The low-pressure chamber 38 is filled with the fuel of which pressure is lower than that in the control chamber 35. The low-pressure chamber 38 is fluidly connected to the return pipe 8*b*. The surplus fuel discharged through the outlet passage 33 flows through the return pipe 8*b*.

The control seat surface 26 is formed on an upper end surface of the passage-forming member 22, which is in contact with the injector body member 21. The control seat surface 26 is annularly formed in such a manner as to surround the discharge opening 33*b*.

The opening wall 27 is formed on a lower end surface of the passage-forming member 22, which is in contact with the nozzle body member 23. The opening wall 27 is a part of a defining wall 70*a* which defines the control chamber 35. The opening wall 27 forms a ceiling of the control chamber 35. The inlet opening 32*a* and the outlet opening 33*a* are provided to the opening wall 27. The movable plate 60 sits on or moves away from the opening wall 27.

The injection port 39 is formed on a tip end of the valve body 20 which is inserted into the cylinder head 2*a* (refer to FIG. 1). The injection port 39 is exposed to the combustion chamber 2*b*. The tip end of the valve body 20 has a conical shape or a half sphere shape. A plurality of injection ports 39 are formed radially outwardly from an inner wall of the valve body 20. High-pressure fuel is injected into the combustion chamber 2*b* through each injection port 39. When the high-pressure fuel flows through the injection port 39, the high-pressure fuel is atomized to be easily mixed with air.

The nozzle needle 50 has a columnar shape. The nozzle needle 50 reciprocates in the valve body 20 according to the fuel pressure in the control chamber 35 so as to open/close the injection port 39. The nozzle needle has a conical tip end confronting the injection port 39. The nozzle body member 23 accommodates the nozzle needle 50 in such a manner that the nozzle needle 50 receives hydraulic pressure from the high-pressure fuel supplied through the high-pressure fuel passage 31 so as to open the injection port 39. The nozzle needle 50 receives biasing force from the needle spring 53 to close the injection port 39. The nozzle needle 50 has a pressure receiving surface 51 and a sliding surface 52.

The pressure receiving surface 51 is formed on an axial end of the nozzle needle 50 which confronts the control chamber 35. The pressure receiving surface 51 receives hydraulic pressure from the high-pressure fuel in the control chamber 35 to close the injection port 39. The sliding surface 52 slides on an inner wall surface of the cylinder 70 in an oil tight manner.

The electromagnetic control valve 40 is a mechanism for opening/closing the discharge opening 33*b*. The electromagnetic control valve 40 includes a control valve body 42 and a driving portion 41. The control valve body 42 opens/closes the discharge opening 33*b*. The driving portion 41 displaces the control valve body 42. When the driving portion 41 receives no driving current from the control unit 9, the control valve body 42 sits on the control seat surface 26, whereby a fuel flowing from the control chamber 35 to the low-pressure chamber 38 is interrupted. Meanwhile, when the driving portion 41 receives a driving current from the control unit 9, the driving portion 41 moves the control valve body 42 apart from the control seat surface 26, whereby the fuel can flow from the control chamber 35 into the low-pressure chamber 38.

The movable plate 60 is disc-shaped. The movable plate 60 is arranged in the control chamber 35. The movable plate 60 reciprocates in an axial direction of the nozzle needle 50. The movable plate 60 has a communication hole 61 at its center, which penetrates the movable plate 60 in its axial direction. When the control valve body 42 opens the discharge opening 33*b*, the fuel in the control chamber 35 flows through the communication hole 61 and the outlet passage 33 to be discharged into the low-pressure chamber 38. The communication hole 61 has an out-orifice 62.

When the movable plate 60 sits on the opening wall 27 to close the inlet opening 32*a*, the out-orifice 62 limits a fuel quantity flowing through the communication hole 61, so that a specified fuel quantity flows out from the control chamber 35 into the outlet passage 33. An inner diameter d2 of the communication hole 61 is about 0.1 mm. The out-orifice 62 enlarges a differential pressure between an upper surface and a lower surface of the movable plate 60 in its axial direction. The movable plate 60 is biased toward the opening wall 27 by the differential pressure so as to close the inlet opening 32*a*. The movable plate 60 functions as a three-way valve, and realizes a static leak-less structure which prevents that high-pressure fuel always flows from the inlet opening 32*a* into the control chamber 35.

The support spring 68 is a coil spring. An outer diameter of the support spring 68 is smaller than that of the movable plate 60. The support spring 68 is disposed in the control chamber 35 in a compressed condition. The support spring 68 and the movable plate 60 are substantially coaxial with each other. The support spring 68 biases the movable plate 60 toward the opening wall 27 so that the movable plate 60 is returned to an initial position where the movable plate 60 is in contact with the opening wall 27.

Next, a configuration of the cylinder defining the control chamber 35 will be described in detail. The cylinder 70 divides the control chamber 35 into two spaces in the axial direction. Specifically, the control chamber 35 is divided into a backpressure chamber 36 and an accommodation chamber 37. The cylinder 70 has a dividing wall portion 75, a first circumferential wall portion 71, a second circumferential wall portion 72 and a third circumferential wall portion 73.

The backpressure chamber 36 confronts the pressure receiving surface 51. The backpressure chamber 36 is defined by the dividing wall portion 75, the third circumferential wall portion 73 and the pressure receiving surface 51. An inner diameter of the backpressure chamber 36 is about 3.5 mm. The fuel pressure in the backpressure chamber 36 is applied to the nozzle needle 50.

The accommodation chamber 37 confronts the opening wall 27. The accommodation chamber 37 is defined by the dividing wall portion 75, the first circumferential wall portion 71, the second circumferential wall portion 72 and the opening wall 27. The accommodation chamber 37 and the backpressure chamber 36 are concentrically formed with each other. The accommodation chamber 37 accommodates the movable plate 60 and the support spring 68. A volume of the fuel filling the accommodation chamber 37 is lower than that filling the backpressure chamber 36 when the nozzle needle 50 closes the injection port 39.

The dividing wall portion 75 is positioned between the second circumferential wall portion 72 and the third circumferential wall portion 73 in the axial direction of the cylinder 70. The dividing wall portion 75 extends in a direction which is orthogonal to the axial direction of the cylinder 70. The dividing wall portion 75 divides the control chamber 35 into the backpressure chamber 36 and the accommodation chamber 37. The dividing wall portion 75 has a supporting surface 76 and a restriction hole 77.

The supporting surface 76 is formed on an upper surface of the dividing wall portion 75, which confronts the accommodation chamber 37. One end of the support spring 68 is fixed on the supporting surface 76. The supporting surface 76 supports the support spring 68, whereby the support spring 68 is isolated from a movement of the nozzle needle 50.

The restriction hole 77 is an aperture penetrating the dividing wall portion 75 in its thickness direction. The restriction hole 77 is positioned at a center of the dividing wall portion 75. The supporting surface 76 is formed around the restriction hole 77. The restriction hole 77 is formed coaxially with the backpressure chamber 36 and the accommodation chamber 37. The restriction hole 77 fluidly connects the backpressure chamber 36 and the accommodation chamber 37 with each other.

An inner diameter d3 of the restriction hole 77 is larger than the inner diameter d2 of the out-orifice 62, and is smaller than the inner diameter d1 of the backpressure chamber 36. The inner diameter d3 of the restriction hole 77 is about 02-0.8 mm. The inner diameter d3 of the restriction hole 77 is twice to seven times of the inner diameter d2 of the out-orifice 62. A flow passage area A3 of the restriction hole 77 is larger than a flow passage area A2 of the out-orifice 62. The flow passage area A3 is four times to fifty times of the flow passage area A2. It is preferable that the inner diameter d3 of the restriction hole 77 is less than half of the inner diameter d1 of the backpressure chamber 36. It is more preferable that the inner diameter d3 of the restriction hole 77 is one-fifth of the inner diameter d1 of the backpressure chamber 36 in order to reduce a pressure pulsation in the backpressure chamber 36.

The first circumferential wall portion 71 is closest to the opening wall 27 among the circumferential wall portions of the cylinder 70. The first circumferential wall portion 71 defines the accommodation chamber 37 and surrounds the movable plate 60. An inner diameter d21 of the first circumferential wall portion 71 is slightly larger than an outer diameter of the movable plate 60.

The second circumferential wall portion 72 is an inner circumferential wall portion between the first circumferential wall portion 71 and the dividing wall portion 75. The second circumferential wall portion 72 defines the accommodation chamber 37 and surrounds the support spring 68. An inner diameter d22 of the second circumferential wall portion 72 is slightly larger than an outer diameter of the support spring 68, and is smaller than the inner diameter d21 of the first circumferential wall portion 71.

The third circumferential wall portion 73 defines the backpressure chamber 36 along with the dividing wall portion 75 and the pressure receiving surface 51. The third circumferential wall portion 73 is coaxial with the first and the second circumferential wall portion 71, 72. The third circumferential wall portion 73 slidably supports the sliding surface 52 of the nozzle needle 50. The inner diameter of the third circumferential wall portion 73 is the inner diameter d1 of the backpressure chamber 36, and is slightly larger than the inner diameter d21 of the first circumferential wall portion 71. The inner diameter d1 of the third circumferential wall portion 73 is larger than the inner diameter d22 of the second circumferential wall portion 72.

When the control unit 9 commands the electromagnetic control valve 40 to be opened, the fuel flows out from the control chamber 35 into the low-pressure chamber 38 through the out-orifice 62 and the outlet passage 33. The fuel pressure in the control chamber 35 falls and the nozzle needle 50 is pushed up by high-pressure fuel in a vicinity of the injection port, so that a fuel injection is started.

Meanwhile, when the control unit 9 controls the electromagnetic control valve 40 to be closed, hydraulic pressure biasing the movable plate 60 onto the opening wall 27 is decreased. Consequently, the movable plate 60 moves away from the opening wall 27 by fuel pressure in the inlet opening 32*a*, whereby the high-pressure fuel can flow into the control chamber 35. When the fuel pressure in the control chamber 35 is recovered, the nozzle needle 50 is pushed down to close the injection port 39.

According to the above first embodiment, the control chamber 35 is divided into the backpressure chamber 36 and the accommodation chamber 37 by the dividing wall portion 75, and the backpressure chamber 36 and the accommodation chamber 37 are communicated with each other through the restriction hole 77. Therefore, even when a volume of the control chamber 35 is enlarged, an increase in volume of the backpressure chamber 36 can be restricted compared to a case in which no dividing wall portion 75 is provided. According to the above, a pulsation period of the fuel pressure in the backpressure chamber 36 is shorted, so that the pressure pulsation converges precociously. Thus, it is avoided that a displacement speed of the nozzle needle 50 varies in a wavelike fashion. Consequently, the variation in fuel injection quantity with respect to an opening period of the electromagnetic control valve 40 can be reduced.

Furthermore, according to the first embodiment, the support spring 68 is supported by the supporting surface 76 of the dividing wall portion 75. Therefore, even when the pressure receiving surface 51 comes close to the movable plate 60 due to a large displacement of the nozzle needle 50 (refer to two-dot chain line in FIG. 3), the support spring 68 is not compressed excessively. The support spring 68 can bias the movable plate into the opening wall 27 in a proper posture. Consequently, the variation in behavior of the movable plate 60 can be restrained. According to the above, it is restricted that a variation in fuel quantity flowing into the control chamber 35 after the electromagnetic control valve 40 is closed is varied. The displacement of the nozzle needle 50 to close the injection port 39 can be stabilized. Consequently, the variation in fuel injection quantity with respect to an opening period of the electromagnetic control valve 40 can be reduced.

Therefore, even if the displacement of the nozzle needle 50 is enlarged to increase the fuel injection quantity, the fuel injection quantity can be controlled with high accuracy.

Furthermore, since the supporting surface 76 of the dividing wall portion 75 supports the support spring 68, a restriction of compression allowance of the support spring 68 can be made substantially zero. Consequently, a maximum lift amount of the nozzle needle 50 can be easily increased. Furthermore, the support spring 68 does not receive any upward movement from the nozzle needle 50. Thus, the support spring 68 biases the movable plate 60 stably, so that the movable plate 60 is not tilted. An accuracy of the fuel injection can be further improved.

The inner diameter d3 of the restriction hole 77 is less than half of the inner diameter d1 of the backpressure chamber 36. The restriction hole 77 surely suppresses the pressure pulsation in the backpressure chamber 36.

Moreover, the flow passage area A3 of the restriction hole 77 is larger than the flow passage area A2 of the out-orifice 62. With this configuration, the restriction hole 77 does not prevent the fuel from flowing out from the backpressure chamber 36, substantially. Thus, the fuel pressure in the backpressure chamber 36 promptly falls after the electromagnetic control valve 40 is opened, similar to a configuration in which the dividing wall portion 75 is not formed. Therefore, both the injection accuracy and the responsibility can be kept high.

Furthermore, according to the first embodiment, the volume of the fuel filling the accommodation chamber 37 is less than the volume of the fuel filling the backpressure chamber 36. Since the volume of the fuel filling the accommodation chamber 37 is small, the fuel pressure drop in the control chamber 35 is promptly generated after the electromagnetic control valve 40 is opened. According to the above, the high responsibility to the control unit 9 is ensured.

The inner diameter d22 of the second circumferential wall portion 72 is smaller than the inner diameter d21 of the first circumferential wall portion 71. According to the above, since the excessive volume of the accommodation chamber 37 can be reduced, the fuel quantity filling the accommodation chamber 37 can be decreased. The pressure drop delay in the control chamber 35 can be substantially avoided, and a lift start timing of the nozzle needle 50 can be close to a valve opening timing of the electromagnetic control valve 40. Therefore, a high responsibility of the fuel injection device 10 can be ensured even though the control chamber 35 is divided.

It should be note that the nozzle needle 50 correspond to a needle, the movable plate 60 corresponds to a closing member, and the support spring 68 corresponds to a biasing member.

Second Embodiment

Figure 4:
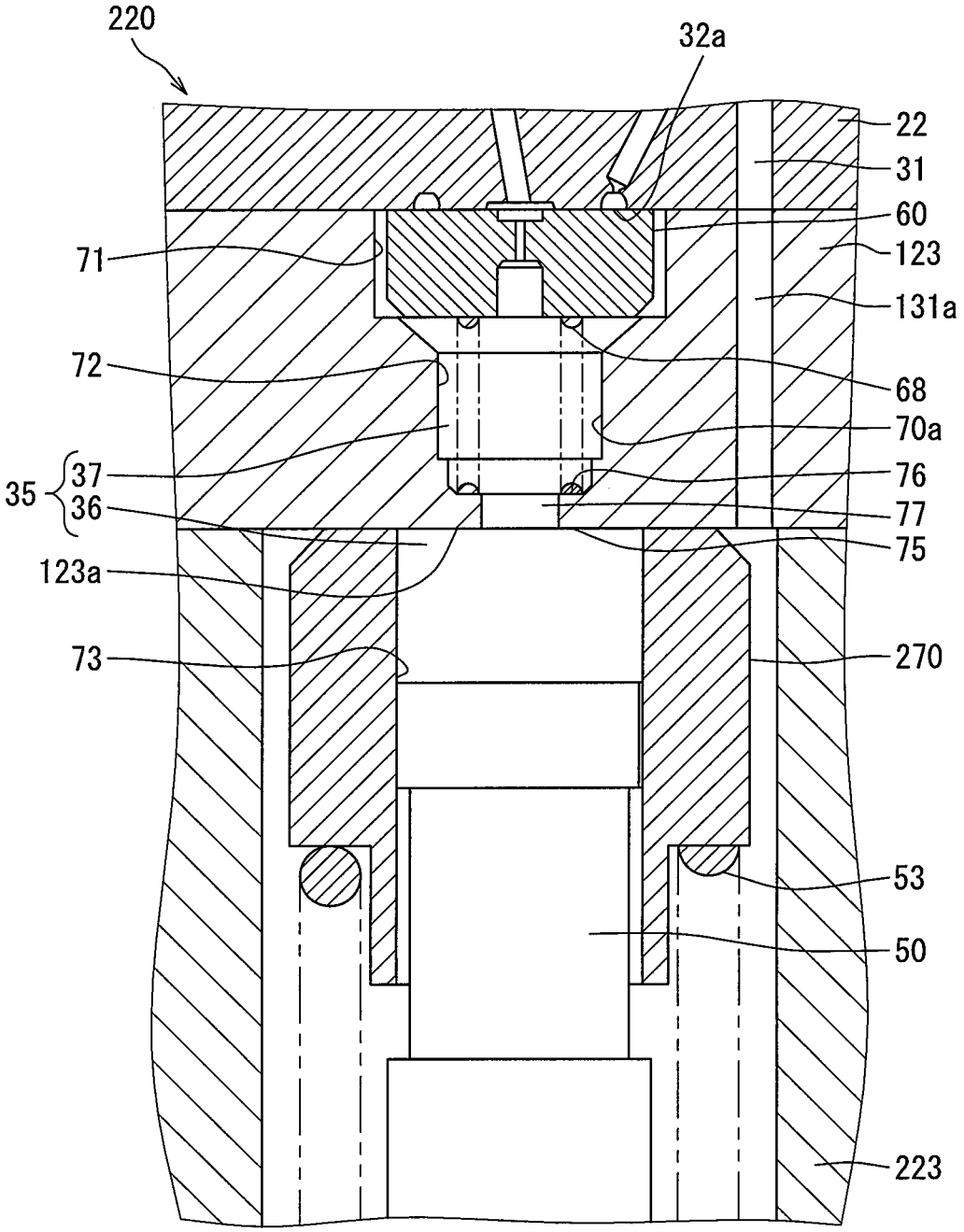
FIG. 4 is a longitudinal sectional view illustrating a vicinity of a control chamber in the fuel injection device according to a second embodiment.

A second embodiment shown in FIG. 4 is a modification of the first embodiment. The valve body 220 has a nozzle body member 223 and a valve accommodation member 123. A cylinder 270 defines the backpressure chamber 36 only.

The valve accommodation member 123 is column-shaped. The valve accommodation member 123 is concentrically disposed between the passage-forming member 22 and the nozzle body member 223. The valve accommodation member 123 has a longitudinal hole 131*a*. The longitudinal hole 131*a* penetrates the valve accommodation member 123 in its axial direction. The longitudinal hole 131*a* is a part of the high-pressure fuel passage 31.

The valve accommodation member 123 defines the accommodation chamber 37. The valve accommodation member 123 has the first circumferential wall portion 71, the second circumferential wall portion 72 and the dividing wall portion 75 which are the defining wall 70*a* defining the accommodation chamber 37. The valve accommodation member 123 accommodates the movable plate 60 and the support spring 68. The support spring 68 is disposed between the supporting surface 76 of the dividing wall portion 75 and the movable plate 60 in compressed state.

The nozzle body member 223 accommodates the cylinder 270. The needle spring 53 biases the cylinder 270 onto a lower end surface 123*a* of the valve accommodation member 123. The cylinder 270 has the third circumferential wall portion 73 which defines the backpressure chamber 36. The backpressure chamber 36 communicates with the accommodation chamber 37 through the restriction hole 77.

Also in the second embodiment, since the control chamber 35 is divided into the accommodation chamber 37 and the backpressure chamber 36, the pressure pulsation generated in the backpressure chamber 36 can be converged promptly. In addition, since the support spring 68 does not receive any movement of the nozzle needle 50, the movable plate 60 can open/close the inlet opening 32*a* properly. Therefore, the fuel can be injected through the injection port 39 with high accuracy.

In the second embodiment, the backpressure chamber is defined by the cylinder 270, and the accommodation chamber 37 is defined by the valve accommodation member 123. The dividing wall portion 75 and the restriction hole 77 are formed at the lower end surface 123*a* of the valve accommodation member 123. Thus, the accommodation chamber 37 and the restriction hole 77 can be easily formed by cutting work etc. As mentioned above, since the backpressure chamber 36 and the accommodation chamber 37 are formed by different members respectively, high working accuracy can be ensured. Furthermore, swarf can be easily removed after cutting work.

Third Embodiment

Figure 5:
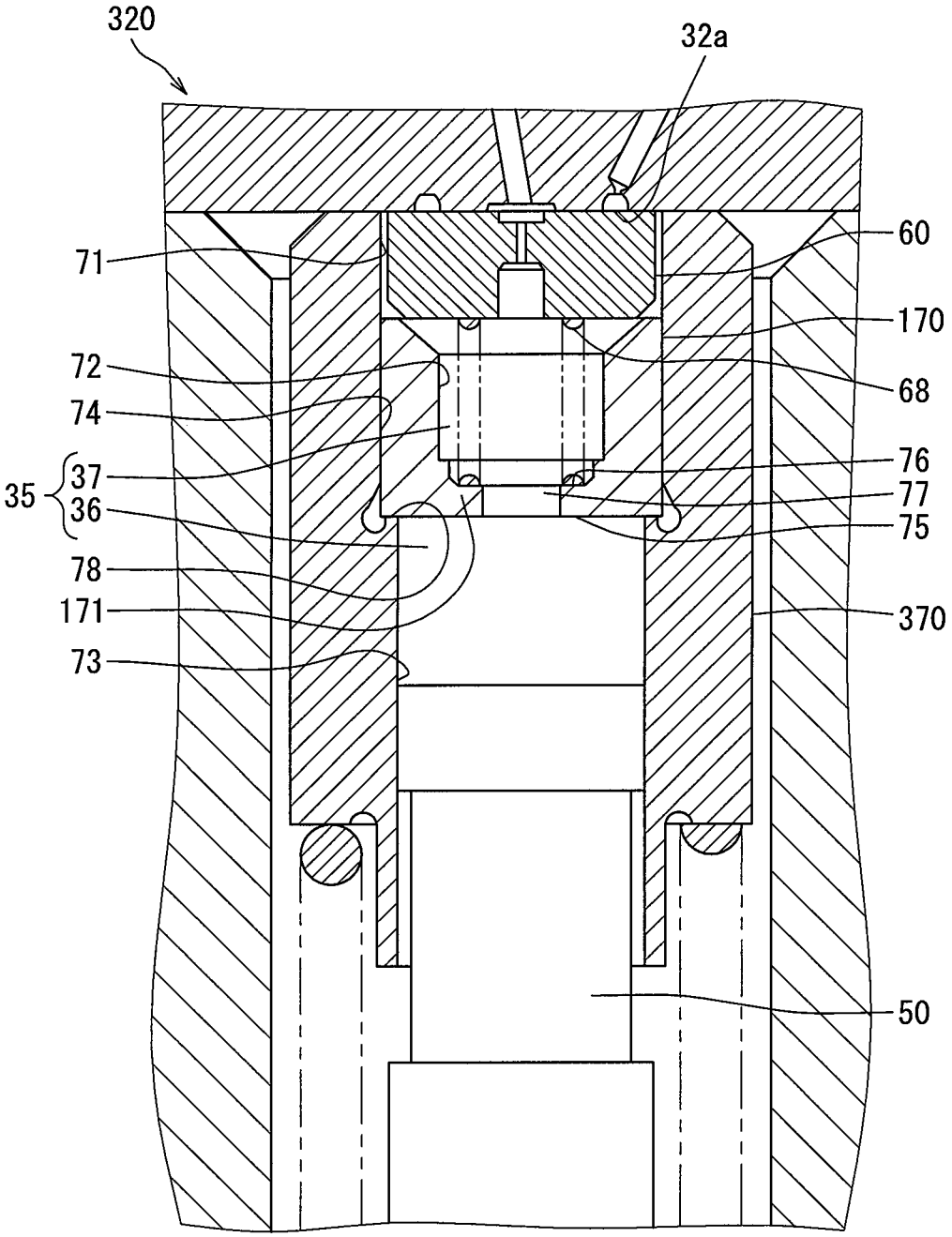
FIG. 5 is a longitudinal sectional view illustrating a vicinity of a control chamber in the fuel injection device according to a third embodiment.

A third embodiment shown in FIG. 5 is another modification of the first embodiment. A valve body 320 has an outer cylinder 370 and an inner cylinder 170.

The outer cylinder 370 surrounds an entire circumference of the control chamber 35. The outer cylinder 370 has the first circumferential wall portion 71, the third circumferential wall portion 73, a sliding wall portion 74 and a limiting portion 78. The sliding wall portion 74 is formed between the first circumferential wall portion 71 and the third circumferential wall portion 73 in its axial direction. The sliding wall portion 74 and the first circumferential wall portion 71 are continuously formed. An inner diameter of the sliding wall portion 74 is equal to an inner diameter of the first circumferential wall portion 71, and is substantially equal to an outer diameter of the inner cylinder 170. The limiting portion 78 is a step which is formed between the sliding wall portion 74 and the third circumferential wall portion 73. The limiting portion 78 limits a displacement of the inner cylinder 170 in a direction that the inner cylinder 170 comes close to the nozzle needle 50.

The inner cylinder 170 is a cylinder having a bottom wall. The inner cylinder 170 is accommodated in the outer cylinder 370 in alignment with the movable plate 60. The inner cylinder 170 is slidably engaged with the sliding wall portion 74 of the outer cylinder 370. The inner cylinder 170 has the second circumferential wall portion 72 and the dividing wall portion 75.

The dividing wall portion 75 corresponds to the bottom wall 171 of the inner cylinder 170. The bottom wall 171 defines the supporting surface 76. One end of the support spring 68 is fixed on the supporting surface 76. The support spring 68 biases the inner cylinder 170 so that the bottom wall 171 is brought into contact with the limiting portion 78. The bottom wall 171 has the restriction hole 77.

Also in the third embodiment, since the control chamber 35 is divided into the accommodation chamber 37 and the backpressure chamber 36, the pressure pulsation generated in the backpressure chamber 36 can be converged promptly. In addition, since the support spring 68 does not receive any movement of the nozzle needle 50, the movable plate 60 can open/close the inlet opening 32*a* properly. Therefore, the fuel can be injected through the injection port 39 with high accuracy.

In addition, a position of the restriction hole 77 is varied according to a sliding movement of the inner cylinder 170. Therefore, the movement of the restriction hole 77 along with a pressure pulsation in the backpressure chamber 36 generates a damper effect. The pressure pulsation in the backpressure chamber 36 can converge promptly.

Moreover, since the dividing wall portion 75 and the restriction hole 77 are provided to the bottom wall 171, the dividing wall portion 75 and the restriction hole 77 can be formed easier than a configuration where the dividing wall portion and the dividing hole are formed at a middle of inside of the cylinder. Consequently, high cutting accuracy can be maintained. Swarf can be easily removed.

In the third embodiment, the inner cylinder 170 corresponds to an inner cylinder member, and the outer cylinder 370 corresponds to an outer cylinder member.

Another Embodiment

While the present disclosure has been described with reference to multiple embodiments thereof, it is to be understood that the disclosure is not limited to the embodiments and constructions. The present disclosure is intended to cover various modification and equivalent arrangements within the spirit and scope of the present disclosure.

In the first embodiment, the dividing wall portion supporting the support spring is formed integrally with the cylinder. In the second and the third embodiment, the supporting member supporting the support spring is formed separately from the valve accommodation member and the inner cylinder. As above, the configuration for defining the control chamber may be changed suitably.

In the above mentioned embodiments, the support spring is a coil spring. However, the support spring may be a plate spring.

In the above embodiments, the restriction hole has a circular cross-section. However, shape and size of the restriction hole may be suitably changed as long as a pulsation can be restricted. Furthermore, each of the backpressure chamber and the accommodation chamber may be suitably changed in its shape and volume.

The electromagnetic control valve may be replaced by a control valve having a piezo actuator. The above fuel injection device may inject fuel other than light oil.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A fuel injection device comprising:

a valve body which defines an injection port, a control chamber filled with a fuel, an inlet passage for introducing the fuel into the control chamber, and an outlet passage for discharging the fuel from the control chamber;

a needle provided in a displaceable manner in the valve body by a variation in fuel pressure in the control chamber so as to open/close the injection port;

a closing member which is accommodated in the control chamber in a displaceable manner inside the valve body so as to close an inlet opening of the inlet passage, which opens on an opening wall confronting the control chamber;

a biasing member which is accommodated in the control chamber inside the valve body in such a manner as to bias the closing member toward the opening wall; and a cylinder provided inside the valve body in a displaceable manner, wherein the control chamber is defined by a defining wall which has a dividing wall portion, the dividing wall portion divides the control chamber into a backpressure chamber for applying a fuel pressure to the needle and an accommodation chamber accommodating the closing member and the biasing member, the dividing wall portion has a restriction hole fluidly connecting the accommodation chamber and the backpressure chamber with each other, the dividing wall portion has a support surface supporting the biasing member, the biasing member is provided to bias the closing member in a direction to close the inlet opening of the inlet passage, and the cylinder defines therein at least the backpressure chamber.

2. The fuel injection device according to claim 1, wherein the restriction hole and the backpressure chamber are formed in cylindrical shape, and an inner diameter of the restriction hole is not greater than half of an inner diameter of the backpressure chamber.

3. The fuel injection device according to claim 1, wherein a volume of the fuel filling the accommodation chamber is less than a volume of the fuel filling the backpressure chamber when the needle closes the injection port.

4. The fuel injection device according to claim 1, wherein the defining wall has a first circumferential wall portion surrounding the closing member and a second circumferential wall portion surrounding the biasing member, and an inner diameter of the second circumferential wall portion is smaller than an inner diameter of the first circumferential wall portion.

5. The fuel injection device according to claim 1, wherein the cylinder is an outer cylinder member;

the fuel injection device further comprises an inner cylinder member within the outer cylinder member;

the outer cylinder member surrounds the control chamber and the inner cylinder member;

the inner cylinder member is slidably engaged with an inner wall of the outer cylinder member; and the backpressure chamber and the accommodation chamber are both provided inside the cylinder.

6. The fuel injection device according to claim 1, wherein the closing member is disc-shaped and has a communication hole at a center of the closing member which penetrates the closing member in an axial direction of the closing direction, the axial direction of the closing member being a direction in which the closing member is displaceable.

7. The fuel injection device according to claim 1, wherein the backpressure chamber and the accommodation chamber are coaxially aligned along a longitudinal axis of the control chamber.

8. The fuel injection device according to claim 1, wherein the inlet opening of the inlet passage opens on the opening wall, and an outlet opening of the outlet passage also opens on the opening wall.

9. The fuel injection device according to claim 1, wherein the dividing wall is provided to be orthogonal to an axial direction of the cylinder and movable with the cylinder, and divides the control chamber into the backpressure chamber and the accommodation chamber; and the closing member and the biasing member are accommodated inside the accommodation chamber.

10. The fuel injection device according to claim 1, wherein the valve body has an accommodation member provided separately from the cylinder and having the dividing wall, which is orthogonal to an axial direction of the cylinder and defines the accommodation chamber to accommodate the closing member and the biasing member inside the accommodation member; and the cylinder is provided adjacent to the accommodation member and defines only the backpressure chamber therein.

11. A fuel injection device comprising:

a valve body which defines an injection port, a control chamber filled with a fuel, an inlet passage for introducing the fuel into the control chamber, and an outlet passage for discharging the fuel from the control chamber;

a needle which will be displaced by a variation in fuel pressure in the control chamber so as to open/close the injection port;

a closing member which is accommodated in the control chamber in a displaceable manner so as to close an inlet opening of the inlet passage, which opens on an opening wall confronting the control chamber; and a biasing member which is accommodated in the control chamber in such a manner as to bias the closing member toward the opening wall, wherein the control chamber is defined by a defining wall which has a dividing wall portion, the dividing wall portion divides the control chamber into a backpressure chamber for applying a fuel pressure to the needle and an accommodation chamber accommodating the closing member and the biasing member, the dividing wall portion has a restriction hole fluidly connecting the accommodation chamber and the backpressure chamber with each other, the dividing wall portion has a support surface supporting the biasing member, the closing member has an out orifice which limits an amount of the fuel flowing out from the control chamber, and a flow passage area of the restriction hole is greater than a flow passage area of the out orifice.

12. A fuel injection device comprising:

a valve body which defines an injection port, a control chamber filled with a fuel, an inlet passage for introducing the fuel into the control chamber, and an outlet passage for discharging the fuel from the control chamber;

a needle which will be displaced by a variation in fuel pressure in the control chamber so as to open/close the injection port;

a closing member which is accommodated in the control chamber in a displaceable manner so as to close an inlet opening of the inlet passage, which opens on an opening wall confronting the control chamber; and a biasing member which is accommodated in the control chamber in such a manner as to bias the closing member toward the opening wall, wherein the control chamber is defined by a defining wall which has a dividing wall portion, the dividing wall portion divides the control chamber into a backpressure chamber for applying a fuel pressure to the needle and an accommodation chamber accommodating the closing member and the biasing member, the dividing wall portion has a restriction hole fluidly connecting the accommodation chamber and the backpressure chamber with each other, the dividing wall portion has a support surface supporting the biasing member, and the closing member has an out orifice which fluidly connects the accommodation chamber and the outlet passage.

* * * * *